US006452143B1

(12) United States Patent
Choi

(10) Patent No.: US 6,452,143 B1
(45) Date of Patent: Sep. 17, 2002

(54) DEVICE FOR LINEARLY MOVING TRAY IN MICROWAVE OVEN

(75) Inventor: Sung-Su Choi, Changwon (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/931,918

(22) Filed: Aug. 20, 2001

(30) Foreign Application Priority Data

Jun. 19, 2001 (KR) ..... 2001-0034852

(51) Int. Cl.[7] ..... H05B 6/78

(52) U.S. Cl. ..... 219/753; 219/754; 219/762; 126/388; 108/140; 108/141

(58) Field of Search ..... 219/753, 754, 219/755, 752, 762, 763; 126/388; 108/20, 139, 140, 141

(56) References Cited

U.S. PATENT DOCUMENTS 4,121,078 A * 10/1978 Takano et al. ..... 219/754
4,503,307 A * 3/1985 Campbell et al. ..... 219/753
5,166,486 A * 11/1992 Komatsu et al. ..... 219/753
5,192,842 A 3/1993 Kim ..... 219/754
5,315,086 A * 5/1994 Pressouyre ..... 219/753

FOREIGN PATENT DOCUMENTS

JP 52-36347 * 3/1977 ..... 219/754
JP 404356623 A 12/1992

* cited by examiner

*Primary Examiner*—Philip H. Leung
(74) *Attorney, Agent, or Firm*—Fleshner & Kim, LLP

(57) ABSTRACT

A driving mechanism for linearly and reciprocatingly moving items in a heating chamber of a microwave oven is provided. The driving mechanism includes a rectangular tray for loading thereon an item to be heated within a heating chamber and a driving motor for generating a rotational force. A cam is provided for converting the rotational motion of the driving motor into a linear and reciprocating motion of the tray. The driving mechanism also includes a roller assembly mounted between the bottom of the heating chamber and the tray, the roller assembly including rollers for supporting the tray so as to linearly and reciprocatingly move the tray. Convex portions are formed on the bottom surface of the heating chamber on which the rollers move, and the tray can move in the vertical direction by means of the rollers passing over the convex portions. By moving the item both horizontally and vertically, the item can be uniformly heated, and the space within the heating chamber can be more efficiently used.

15 Claims, 2 Drawing Sheets

DEVICE FOR LINEARLY MOVING TRAY IN MICROWAVE OVEN

BACKGROUND OF THE INVENTION

1. Field of the Invention

The present invention relates to a device for linearly moving a tray in a microwave oven, and more particularly, to a device for linearly moving a tray in a microwave oven in which the tray for loading a foodstuff to be heated thereon has the same rectangular shape as a bottom surface of a heating chamber of the microwave oven and linearly moves.

2. Description of the Prior Art

A microwave oven heats an object (for example, a foodstuff) using a microwave having a constant wavelength. As shown in FIG. 1, the microwave oven includes a heating chamber 2 for heating the foodstuff, and the heating chamber 2 is constructed to be opened and closed by a door 4.

The microwave generated from a magnetron (not shown) is supplied into the heating chamber 2, and causes the foodstuff therein to be heated. At this time, the foodstuff should be uniformly heated by the microwave. However, due to the wavelength characteristic of the microwave, it is difficult to uniformly heat the foodstuff in its stationary state.

Therefore, in order to uniformly heat the foodstuff by using the microwave, a tray 6 for loading the foodstuff thereon should be rotated so that the foodstuff can be uniformly heated by the microwave.

As shown in FIG. 1, the ordinary microwave oven constructed such that the foodstuff is heated while the tray 6 for loading the foodstuff thereon is rotated has the following disadvantages.

Generally, the heating chamber 2 is formed to be rectangular as viewed from the top thereof, whereas the tray 6 for loading the foodstuff thereon is constructed to be circular for its rotation. Therefore, within the heating chamber 2, it can be seen that an area used for actually heating the foodstuff corresponds to a circular area covered by the tray 6. The above means that in view of a structure of the tray mounted within the heating chamber of the conventional microwave oven, there are large dead space that cannot be used for actually heating the foodstuff. That is, when using the structures of the heating chamber and tray of the conventional microwave oven, it can be seen that there is a problem in that the usage efficiency of the space within the heating chamber is bounded to a certain limit.

The conventional microwave oven also has the above disadvantages. Furthermore, in a microwave oven that is also used as a hood and is transversely longer, since its transverse length is much longer, dead space that cannot be used for heating the foodstuff becomes much larger.

SUMMARY OF THE INVENTION

The present invention is contemplated to solve the above problems. An object of the present invention is to provide a device for linearly moving a tray in a microwave oven, by which the space within a heating chamber of the microwave oven can be efficiently used as a whole.

Another object of the present invention is to prove a device for linearly moving a tray in a microwave oven, by which a foodstuff loaded on the tray can be uniformly heated.

According to the present invention, since a bottom surface of the heating chamber of the conventional microwave oven is generally formed to be rectangular, the tray is correspondingly formed to be rectangular. Further, the rectangular tray is constructed such that it can move in the vertical direction to a certain degree while moving linearly in the right and left direction.

According to an aspect of the present invention for achieving the above objects, there is provided a device for linearly moving a tray in a microwave oven, comprising: a tray for loading a foodstuff to be heated thereon; a driving motor for generating a rotational force; a converting means for converting a rotational motion from the driving motor into a linear and reciprocating motion of the tray; a supporting means mounted in contact with a bottom surface of the tray for supporting the tray so as to linearly and reciprocatingly move the tray; and convex portions protruding from a bottom surface of a heating chamber in the fore and aft direction to a predetermined height so that the supporting means can move in the vertical direction when a bottom surface of the supporting means moves in contact with the bottom surface of the heating chamber in the right and left direction.

According to another aspect of the present invention, there is also provided a device for linearly moving a tray in a microwave oven, comprising: a tray for loading a foodstuff to be heated thereon; a driving motor for generating a rotational force; a converting means for converting a rotational motion from the driving motor into a linear and reciprocating motion of the tray; a vertically moving means for moving the tray in the vertical direction as well as in the right and left direction when the tray linearly and reciprocatingly moves in the right and left direction by the converting means; and a supporting means for supporting the tray so as to move the tray in the right and left direction and the vertical direction.

According to an embodiment of the converting means of the present invention, the converting means comprises a slit formed in the bottom surface of the tray and having a predetermined length, and a rotating member with an eccentric protrusion formed at an eccentric position and inserted into the slit, and wherein the rotating member is rotated by the driving motor so that the tray can linearly and reciprocatingly move depending on an amount of rotation of the eccentric protrusion.

According to an embodiment of the tray of the present invention, when the tray has the same rectangular shape as the bottom surface of the heating chamber, the space within the heating chamber can be efficiently used.

According to an embodiment of the supporting means of the present invention, the supporting means comprises a frame formed to have an smaller than that of the bottom surface of the tray, and a plurality of rollers rotatably mounted on the frame, and wherein the tray is supported by the rollers so as to linearly and reciprocatingly move the tray.

According to another embodiment of the supporting means of the present invention, the supporting means comprises a frame formed to have an smaller than an area of the bottom surface of the tray, and a plurality of rollers rotatably mounted on the frame, and wherein the vertically moving means comprises convex portions which protrude in the form of arcs in the fore and aft direction from the bottom surface of the heating chamber contacted with the plurality of rollers.

According to an embodiment of the rollers of the present invention, the rollers comprises four rollers comprised of two pairs of two rollers with respect to the fore and aft direction, and the convex portions comprises a pair of convex portions which have a predetermined width in the right and left direction.

According to the present invention, the tray mounted within the heating chamber of the microwave oven covers large space within the heating chamber, and the microwave can be sufficiently and uniformly irradiated onto the foodstuff by means of the right and left motion and vertical motion of the tray. Therefore, first of all, the foodstuff can be uniformly heated by the microwave. Further, it is expected that the space within the heating chamber of the microwave oven can be efficiently used.

DETAILED DESCRIPTION OF THE INVENTION

Hereinafter, preferred embodiments of the present invention will be explained with reference to the accompanying drawings.

Figure 1:
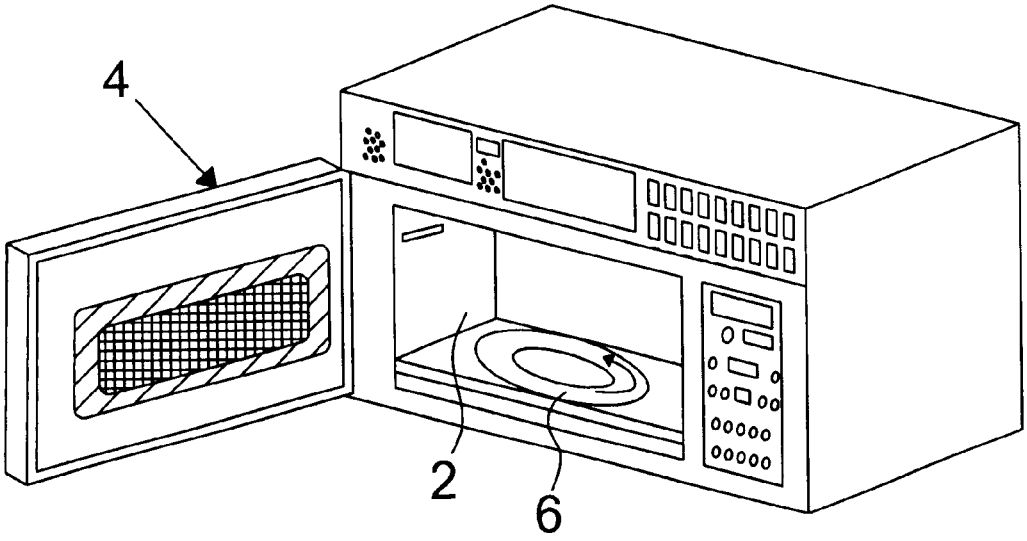
FIG. 1 Prior Art
FIG. 1 is a perspective view showing the constitution within a heating chamber of a conventional microwave oven.
Figure 2:
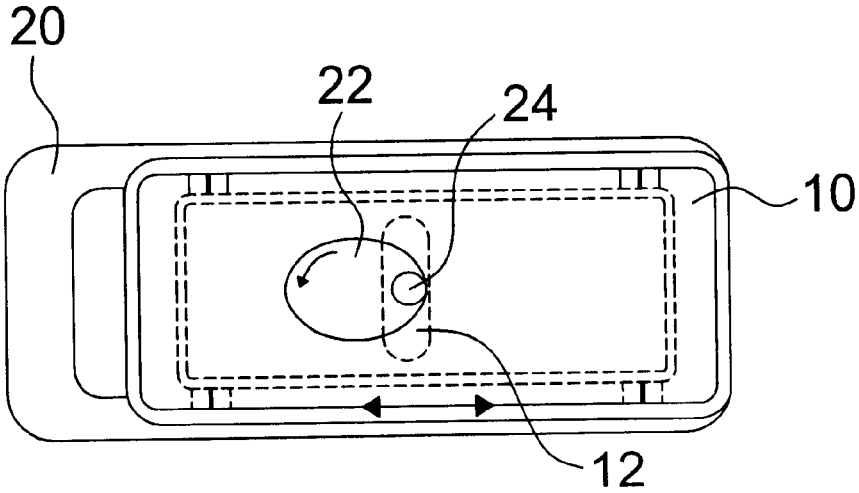
FIG. 2 is a schematic plan view of a device for linearly moving a tray in a microwave oven according to the present invention.

FIG. 2 is a schematic conceptual plan view showing linear movement of a tray in a microwave oven according to the present invention. The shown tray 10 is generally rectangular in shape. It can be seen that this shape of the tray corresponds to that of a bottom surface 20 of a heating chamber of the microwave oven. Thus, according to the spirit of the present invention in which the tray linearly and reciprocatingly moves in the right and left direction and within a predetermined range, forming the tray 10 in the shape of rectangle allows the space within the heating chamber to be efficiently used.

Therefore, compared with a tray of a conventional microwave oven, the tray 10 according to the present invention can cover a substantially relatively larger space within the heating chamber, which means that more foodstuffs can be loaded on a top surface of the tray 10.

According to the present invention, the tray 10 goes through a linear and reciprocating motion in the right and left direction and a vertical motion within a predetermined range of height, instead of a rotational motion of the tray of the conventional microwave oven, as indicated by an arrow in the figure. Thus, by going through the linear and reciprocating motion and the vertical motion, when a microwave having a constant wavelength supplied to the interior of the heating chamber is irradiated onto the foodstuff, the microwave will be more uniformly irradiated onto the foodstuff thereby uniformly heating the foodstuff as a whole. That is, according to the present invention, in order to uniformly irradiate the microwave onto the foodstuff, by linearly and reciprocatingly moving the tray in the right and left direction and simultaneously moving it in the vertical direction, there can be achieved uniform heating, which is an essential criterion at a time of heating in the microwave oven.

Figure 3:
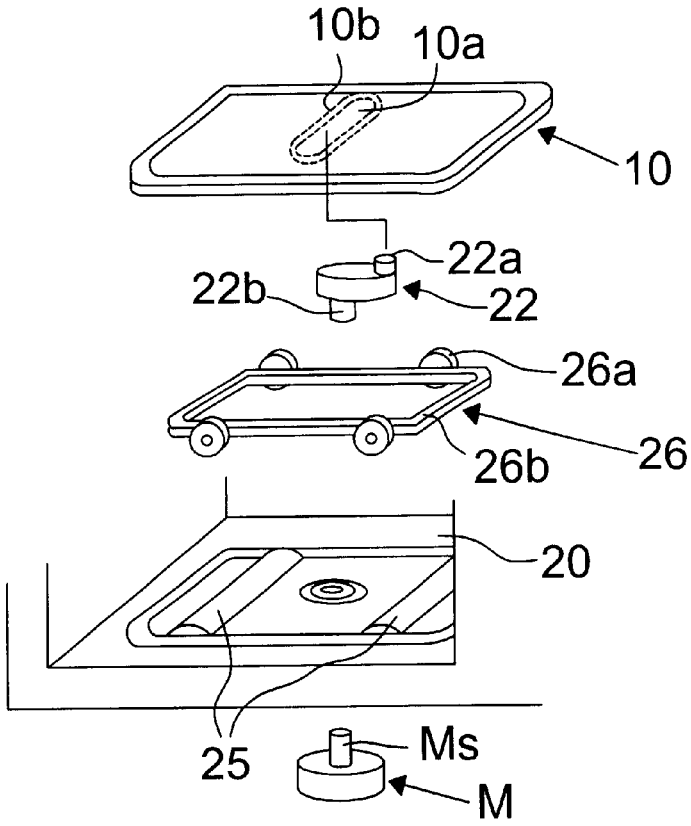
FIG. 3 is an exploded perspective view of the device for linearly moving the tray in the microwave oven according to the present invention.
Figure 4:
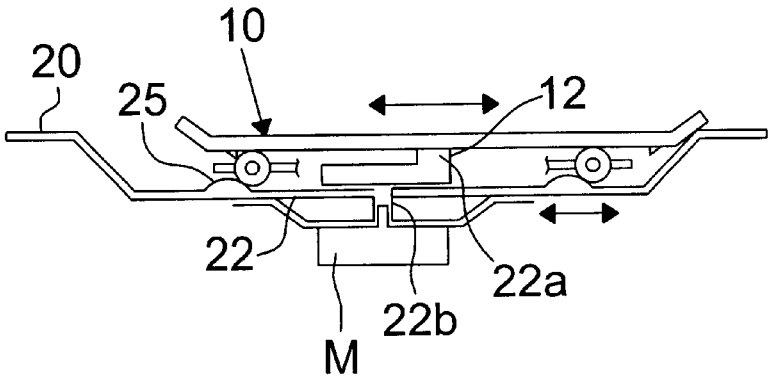
FIG. 4 is a sectional view of the device for linearly moving the tray in the microwave oven according to the present invention.

A specific constitution for the linear and reciprocating motion of the tray in the right and left direction will be explained with reference to FIGS. 3 and 4, which are perspective and sectional views of a device for moving the tray in the microwave oven according to the present invention, respectively.

As shown, according to the present invention, a slit 10*a* having a predetermined length in the fore and aft direction is formed on a bottom surface of the tray 10. This slit 10*a* may be integrally formed with the tray 10, or formed by a separate member. In the illustrated embodiment, the slit 10*a* is formed at the center of the bottom surface of the tray 10 by a circumferential portion 10*b* formed on the bottom surface of the tray 10. The slit 10*a* is formed slightly longer than the range of the linear and reciprocating motion of the tray.

An eccentric protrusion 22*a* formed on a top surface of a rotating member 22 is inserted into the slit 10*a* formed on the bottom surface of the tray 10. The rotating member 22 having the eccentric protrusion 22*a* is constructed to be rotatably coupled with an output shaft Ms of a motor M. In the illustrated embodiment, the output shaft Ms of the motor M is inserted into and fixed to a linking shaft 22*b* formed at the center of a bottom surface of the rotating member 22 so as to transmit a rotational motion of the motor to the rotating member 22. The eccentric protrusion 22*a* protrudes from the top surface of the rotating member 22. Particularly, the eccentric protrusion 22*a* should be formed at an eccentric position radially spaced from the center of the rotating member 22 by a predetermined distance. As the rotating member 22 is rotated, the eccentric protrusion 22*a* moves along a circular of which the diameter is the same as a moving distance of the tray in the right and left direction.

The eccentric protrusion 22*a* should be inserted into the slit 10*a* with a slight play. When inserted into the slit 10*a*, the eccentric protrusion 22*a* can linearly and reciprocatingly move the tray 10 as the rotating member 22 is rotated. That is, when the rotating member 22 is rotated, the eccentric protrusion 22*a* disposed at the eccentric position is also rotated. At this time, the eccentric protrusion 22*a* moves along a predetermined circle due to the eccentricity, and the tray 10 moves in the right and left direction during the circular motion of the eccentric protrusion 22*a*. Since the eccentric protrusion 22*a* inserted into the slit 10*a* of the tray 10 cannot apply any force to the tray 10 in the fore and aft direction, the tray 10 moves substantially only in the right and left direction.

When the tray 10 linearly and reciprocatingly moves in the right and left direction, the amount of movement of the tray 10 substantially depends on the amount of eccentricity of the eccentric protrusion 22*a*. That is, the tray 10 linearly and reciprocatingly moves in the right and left direction by a distance which is two times as large as the amount of eccentricity of the eccentric protrusion 22*a*.

A roller assembly 26 is interposed between a bottom surface 20 of the heating chamber and the tray 10 for supporting and guiding the tray 10 so as to linearly and reciprocatingly move the tray. For example, the roller assembly 26 comprises a rectangular frame 26*b* and a plurality of rollers 26*a* rotatably mounted on the rectangular frame. The rollers 26*a* serve to support the tray 10 so as to linearly and reciprocatingly move with respect to the bottom surface 20 of the heating chamber. That is, top surfaces of the rollers 26*a* come in contact with the tray 10 while bottom surfaces of the rollers 26*a*come in contact with the bottom surface 20 of the heating chamber. Then, when the tray 10 linearly moves, the rollers 26*a* supports and guides the tray 10 to linearly move in the right and left direction.

Alternatively, in a modified embodiment, instead of the roller assembly 26, a plurality of rollers may be mounted directly on the bottom surface of the tray 10. Mounting of the rollers directly on the bottom surface of the tray 10 allows the tray 10 to be smoothly moved and guided in the right and left direction by means of a simpler constitution.

According to the present invention, arc-shaped convex portions 25 protrude from the bottom surface 20 of the heating chamber of the microwave oven. The arc-shaped convex portions 25 are configured to have the same height above the bottom surface 20 of the heating chamber in the fore and aft direction and to be formed thereon at both sides with respect to the tray 10. The rollers 26*a* ride on the tops of the convex portions 25. That is, according to the above constitution, the tray 10 linearly and reciprocatingly moves in the right and left direction. At this time, the rollers 26*a* ride on the tops of the convex portions 25.

When the rollers 26*a* ride on the convex portions 25, the tray 10 substantially moves in the vertical direction via the roller assembly 22. That is, when the tray 10 linearly moves in the right and left direction, the rollers 26*a* ride on the convex portions 25 so that the tray 10 is lifted up to a level corresponding to the height of the convex portions 25. Therefore, the tray moves in the vertical direction along the arc-shaped convex portions 25.

The convex portions 25 can be formed entirely throughout or partially on an area where the tray 10 moves in the right and left direction. It is preferable that the convex portions 25 formed at the right and left sides on the bottom surface of the heating chamber be symmetrically formed so as to keep the tray 10 horizontal. Further, the convex portions 25 should be formed at positions proportional to an interval between the rollers 26*a* in the right and left direction so that all the rollers 26*a* of the roller assembly 26 have the same height.

The driving motor M is mounted on the bottom surface 20 of the heating chamber, and its output shaft protrudes through the bottom surface 20 and is coupled with the linking shaft 22*b* of the rotating member 22. When the motor M is driven, rotational force from the motor M is transmitted to the rotating member 22 via the linking shaft 22*b* so that the rotating member 22 rotates.

Hereinafter, the overall operation of the device for linearly moving the tray in the microwave oven according to the present invention as described above will be explained.

In a state that a foodstuff to be heated is loaded on the top surface of the tray 10, when the microwave oven is operated, the microwave is supplied to the interior of the heating chamber. Concurrently with the supply of the microwave, the tray 10 goes through the vertical motion as well as the linear and reciprocating motion in the right and left direction.

That is, concurrently with the operation of the microwave oven, the driving motor M is driven. The rotational force from the motor M is transmitted from the output shaft Ms of the motor M via the shaft 22*b* to the rotating member 22 so as to rotate the rotating member 22. Since the eccentric protrusion 22*a* of the rotating member 22 is inserted into the slit 10*a* formed on the bottom surface of the tray 10 with a slight play, the rotational motion of the rotating member 22 is converted into the linear and reciprocating motion of the tray 10. Concurrently with the linear and reciprocating motion of the tray 10, the tray 10 goes through the vertical motion by a distance corresponding to the height of the convex portions 25.

The length of the slit 10*a* should be designed to be slightly over two times as large as the amount of eccentricity of the eccentric protrusion 22*a*. That is, since the eccentric protrusion 22*a* is reciprocated within the slit 10*a* in the fore and aft direction when the eccentric protrusion 22*a* is revolved, it is apparent that no interference between the eccentric protrusion 22*a* and the slit 10*a* should be generated.

Therefore, according to the present invention, since the tray 10 goes through the vertical motion as well as the linear and reciprocating motion in the right and left direction within the heating chamber, the microwave can be uniformly irradiated onto the foodstuff loaded on the top surface of the tray so that the foodstuff can be uniformly heated.

It can be understood that the spirit of the present invention is to linearly and reciprocatingly move the tray 10 by converting the rotational force of the driving motor M into the linear and reciprocating motion of the tray 10 and to simultaneously move the tray 10 in the vertical direction by forming the convex portions 25 on the bottom surface 20 of the heating chamber.

In the illustrated embodiment, it can be seen that a combination of the rotating member 22 having the eccentric protrusion 22*a* and the slit 10*a* into which the eccentric protrusion 22*a* is inserted has been described as an example of a converting mechanism for converting the rotational force from the driving motor M into the linear and reciprocating motion of the tray 10.

However, the present invention is not limited to the above embodiment, but the converting mechanism for converting the rotational force from the driving motor M into the linear and reciprocating motion of the tray 10 may be variously modified. In addition, many other mechanical constitutions such as a converting mechanism using a cam or a combination of cranks for implementing an articulation motion can be used for performing the linear and reciprocating motion.

A separate guide may be added for supporting the tray 10, on which the foodstuff is loaded, so as to linearly and reciprocatingly move with respect to the bottom surface 20 of the heating chamber. That is, by forming a structure or mechanism capable of guiding the tray so as to linearly and reciprocatingly move the tray 10 when the tray 10 linearly and reciprocatingly moves by means of the converting means (a converting means for converting the rotational force from the driving motor M into the linear and reciprocating motion of the tray 10), the tray 10 can be safely guided to linearly and reciprocatingly move the tray 10.

Various modifications may be made to the roller assembly 26 mounted between the tray 10 and the bottom surface 20 of the heating chamber for linearly and reciprocatingly move the tray 10. Further, the frame 26*b* can be variously modified in its shape. Furthermore, the rollers 26*a* can be variously modified in their positions and shapes. The rollers 26*a* may be formed directly on the bottom surface of the tray 10.

As explained above, according to the present invention, since the tray 10 goes through the vertical motion as well as the linear and reciprocating motion in the right and left direction, the foodstuff to be heated by the microwave can be uniformly heated. Further, under an essential criterion of uniform heating, it can be seen that since the space within the heating chamber used by the tray in the microwave oven according to the present invention is larger than that of the conventional microwave oven, the space within the heating chamber can be efficiently used. Furthermore, according to the present invention, there is an advantage in view of its usage in that more foodstuffs can be heated compared with the conventional microwave oven having substantially the same capacity.

It will be understood to the skilled in the art that various changes and modifications may be made to the present invention without departing from the spirit and scope of the present invention. It is apparent that the scope of the present invention should be construed only by the accompanying claims.

What is claimed is:

1. A device for linearly moving a tray in a microwave oven, comprising:

a tray for loading a foodstuff to be heated thereon;

a driving motor for generating a rotational force;

a converting means for converting a rotational motion from said driving motor into a linear and reciprocating motion of said tray, wherein said converting means comprises a slit formed in the bottom surface of said tray and having a predetermined length, and a rotating member with an eccentric protrusion formed at an eccentric position and inserted into said slit, and wherein said rotating member is rotated by said driving motor so that said tray can linearly and reciprocatingly move depending on the amount of rotation of said eccentric protrusion;

a supporting means mounted in contact with a bottom surface of said tray for supporting said tray so as to linearly and reciprocatingly move said tray; and convex portions protruding from a bottom surface of a heating chamber in the fore and aft direction to a predetermined height so that supporting means can move in the vertical direction when a bottom surface of said supporting means moves in contact with said bottom surface of said heating chamber in the right and left direction.

2. A device for linearly moving a tray in a microwave oven, comprising:

a tray for loading a foodstuff to be heated thereon;

a driving motor for generating a rotational force;

a converting means for converting a rotational motion from said driving motor into a linear and reciprocating motion of said tray;

a vertically moving means for moving said tray in the vertical direction as well as in the right and left direction when said tray linearly and reciprocatingly moves in the right and left direction by said converting means; and a supporting means for supporting said tray so as to move said tray in the right and left direction and the vertical direction, wherein said supporting means comprises a frame formed to have an area smaller than that of said bottom surface of said tray, and a plurality of rollers rotatably mounted on said frame, and wherein said vertically moving means comprises convex portions which protrude in the form of arcs in the fore and aft direction, from said bottom surface of said heating chamber contacted with the plurality of rollers and said rollers comprise at least four rollers comprised of two pairs of two rollers with respect to the fore and aft direction, and said convex portions comprises a pair of convex portions which have a predetermined width in the right and left direction.

3. A reciprocating mechanism for a microwave oven, comprising:

a tray comprising a slit, wherein the tray is moveably disposed on a bottom of a heating chamber of the microwave oven;

a roller assembly interposed between the tray and bottom of the heating chamber and configured to moveably support the tray;

a cam member rotatably fixed to the microwave oven, and configured to slidably engage the slit in the tray; and a motor configured to rotate the cam member, wherein rotation of the cam member causes the tray to move in a linear reciprocal fashion.

4. The mechanism of claim 3, further comprising a guide to support and linearly guide the tray when the tray moves.

5. The mechanism of claim 3, wherein the tray further comprises rollers to moveably support the tray on the bottom of the heating chamber.

6. The mechanism of claim 5, wherein the bottom of the heating chamber comprises a plurality of arc-shaped convex members configured to raise and lower the tray when the tray moves.

7. The mechanism of claim 3, wherein the roller assembly comprises a rectangular frame and a plurality of rollers.

8. The mechanism of claim 3, wherein the cam member comprises a protrusion disposed proximate to an outer circumference of the cam and configured to slidably engage the slit in the tray and ride therein when the cam member is rotated.

9. The mechanism of claim 8, wherein a length of the slit is at least equal to a diameter of a circle described by the protrusion when the cam member rotates.

10. A reciprocating mechanism for a microwave oven, comprising:

a tray comprising a slit, wherein the tray is moveably disposed on a bottom of a heating chamber of the microwave oven;

a plurality of rolling members configured to movably support the tray on the bottom of the heating chamber;

a cam member rotatably fixed to the microwave oven, and configured to slidably engage the slit in the tray;

a plurality of arc-shaped convex members disposed on the bottom of the heating chamber; and a motor configured to rotate the cam member, wherein rotation of the cam member causes the tray to move in a linear reciprocal fashion along the bottom of the heating chamber.

11. The mechanism of claim 10, wherein the arc-shaped convex members are to move the tray in a vertical direction when the rollers engage the arc-shaped convex members as the tray moves across the bottom of the heating chamber.

12. The mechanism of claim 10, wherein the arc-shaped convex members are symmetrically shaped.

13. The mechanism of claim 10, wherein the arc-shaped convex members are positioned at an interval substantially equal to an interval between the rolling members.

14. The mechanism of claim 10, wherein the rolling members are rotatably attached to the tray.

15. The mechanism of claim 10, wherein the rolling members are rotatably attached to a frame interposed between the tray and the bottom of the heating chamber.

* * * * *